US011083224B2

(12) United States Patent
Lin et al.

(10) Patent No.: US 11,083,224 B2
(45) Date of Patent: Aug. 10, 2021

(54) ELECTRONIC CIGARETTE ATOMIZER WITH FLARED VAPOR OUTLET PIPE

(71) Applicant: Guangrong Lin, Guangdong (CN)

(72) Inventors: Guangrong Lin, Guangdong (CN); Xianbin Zheng, Guangdong (CN)

(73) Assignee: Guangrong Lin, Shenzhen (CN)

( * ) Notice: Subject to any disclaimer, the term of this patent is extended or adjusted under 35 U.S.C. 154(b) by 255 days.

(21) Appl. No.: 16/338,709

(22) PCT Filed: Sep. 8, 2017

(86) PCT No.: PCT/CN2017/101101

§ 371 (c)(1),
(2) Date: Apr. 2, 2019

(87) PCT Pub. No.: WO2018/086406

PCT Pub. Date: May 17, 2018

(65) Prior Publication Data

US 2020/0367557 A1 Nov. 26, 2020

(30) Foreign Application Priority Data

Nov. 14, 2016 (CN) ..... 201611005585.1

(51) Int. Cl.
*A24F 13/00* (2006.01)
*A24F 17/00* (2006.01)
(Continued)

(52) U.S. Cl.
CPC ..... *A24F 40/485* (2020.01); *A24F 40/42* (2020.01); *A24F 40/46* (2020.01); *A24F 40/48* (2020.01); *A24F 40/10* (2020.01); *A24F 40/44* (2020.01)

(58) Field of Classification Search
CPC ..... A24F 47/008; A24F 47/002; A24F 40/00; A24F 40/40
(Continued)

(56) References Cited

U.S. PATENT DOCUMENTS 10,426,199 B2 * 10/2019 Turner ..... A61M 15/06
2015/0020830 A1 * 1/2015 Koller ..... A24F 40/46 131/329

(Continued)

FOREIGN PATENT DOCUMENTS

CN 103653260 A 3/2014
CN 205018291 U 2/2016

OTHER PUBLICATIONS

International Search Report of PCT Patent Application No. PCT/CN2017/101101 dated Dec. 11, 2017.

*Primary Examiner* — Hae Moon Hyeon

(57) ABSTRACT

The present invention has disclosed an electronic cigarette atomizer with a flared vapor outlet pipe, which comprises an atomizer tube body (1), an atomization device (2), and a connecting member (3). One end of the atomizer tube body (1) is a mouthpiece segment (A), the mouthpiece segment (A) contains a hollow mouthpiece cavity (10) which can accommodate an additional material. A vapor outlet pipe (11) is provided; two ends of the vapor outlet pipe (11) respectively communicate with the atomization chamber (20) and the mouthpiece cavity (10); an inner diameter of the vapor outlet pipe (11) gradually increases from an end connected to the atomization chamber (20) to an end connected to the mouthpiece cavity (10). The present invention increases the amount of vapor passing through the nozzle and the flow rate of the vapor at the end of the vapor outlet pipe (11), ultimately increasing atomization efficiency.

9 Claims, 7 Drawing Sheets

(51) Int. Cl.

| | |
|---|---|
| ***A24F 25/00*** | (2006.01) |
| ***A24F 40/485*** | (2020.01) |
| ***A24F 40/48*** | (2020.01) |
| ***A24F 40/46*** | (2020.01) |
| ***A24F 40/42*** | (2020.01) |
| *A24F 40/44* | (2020.01) |
| *A24F 40/10* | (2020.01) |

(58) Field of Classification Search
USPC ..... 131/329, 328
See application file for complete search history.

(56) References Cited

U.S. PATENT DOCUMENTS

| | | | | |
|---|---|---|---|---|
| 2016/0015082 | A1* | 1/2016 | Liu | A24F 47/008 131/329 |
| 2016/0332754 | A1* | 11/2016 | Brown | A24F 47/008 |
| 2018/0000159 | A1* | 1/2018 | Rogan | A61M 11/042 |

* cited by examiner

ELECTRONIC CIGARETTE ATOMIZER WITH FLARED VAPOR OUTLET PIPE

FIELD OF THE INVENTION

The present invention relates to the technical field of electronic cigarettes and particularly relates to an electronic cigarette atomizer with a flared vapor outlet pipe.

BACKGROUND OF THE INVENTION

Traditional tobacco-type cigarettes contain tar, which poses significant health hazards after being inhaled. The health damages caused by tobacco-type cigarettes are widely known. Unlike tobacco-type cigarettes, electronic cigarettes do not impair human health as electronic cigarette liquids do not contain any tar. Therefore, electronic cigarettes are gradually used as a replacement for traditional cigarettes. An electronic cigarette usually generates vapor by heating the electronic cigarette liquid with an atomizer; the vapor is inhaled by the user. The electronic cigarette usually includes an electronic cigarette atomizer connecting with an electronic cigarette battery rod.

Conventional electronic cigarette atomizers are generally small in size, and therefore their atomization chambers are not very large. As a result, the amount of vapor generated in one puff of an electronic cigarette is small. This affects the user experience for those who prefer a large amount of vapor in one puff. In addition, only one single flavor of electronic cigarette can be stored in the atomizer at one time, which also affects the user experience.

SUMMARY OF THE INVENTION

It is an objective of the present invention to overcome the deficiencies of the prior art and to provide an electronic cigarette atomizer with a flared vapor outlet pipe. This electronic cigarette atomizer can increase the amount of vapor inhaled in one puff of an electronic cigarette and can provide a variety of flavors.

The technical solution of the present invention achieved as follows: an electronic cigarette atomizer with a flared vapor outlet pipe, comprising an atomizer tube body, an atomization device, and a connecting member; one end of the atomizer tube body is a mouthpiece segment, another end of the atomizer tube body is an atomizer connection segment, and a middle section of the atomizer tube body is a liquid storage segment; the atomization device is provided with an atomization chamber; the connecting member is for connecting with a battery rod of an electronic cigarette; the mouthpiece segment contains a mouthpiece cavity which has a large cross section and can accommodate an additional material; the atomization device and the connecting member are inserted into the atomizer connection segment; a vapor outlet pipe is provided in the liquid storage segment at its central axis, the vapor outlet pipe is integrally formed with the atomizer tube body; two ends of the vapor outlet pipe respectively communicate with the atomization chamber and the mouthpiece cavity; an inner diameter of the vapor outlet pipe gradually increases from an end connected to the atomization chamber to an end connected to the mouthpiece cavity; a liquid storage chamber for storing an electronic cigarette liquid is formed between the vapor outlet pipe and the atomizer tube body; the atomization device is connected to the liquid storage chamber and the vapor outlet pipe to discharge vapor generated after atomizing the electronic cigarette liquid contained in the liquid storage chamber through the vapor outlet pipe.

Preferably, two ends of the mouthpiece cavity are respectively provided with a blocking sheet, the blocking sheet is provided with a plurality of small through holes.

Preferably, a ribbed plate which is integrally formed is provided between the vapor outlet pipe and the atomizer tube body along an axial direction; the ribbed plate is provided with a ribbed plate through hole to allow circulation of the electronic cigarette liquid stored in the liquid storage chamber.

Preferably, the atomization device includes a throttle support sheet, a liquid permeation sheet, an atomizing seat cover, an atomizing seat, an atomization unit, and an insulation tube; centers of the throttle support sheet and the liquid permeation sheet are respectively provided with a central hole, through which the vapor outlet pipe passes through; the throttle support sheet is provided with a plurality of throttle small holes; the throttle support sheet abuts an end surface of the ribbed plate and seals the liquid storage chamber; the liquid permeation sheet is closely attached to the throttle support sheet to allow the electronic cigarette liquid to penetrate through while preventing leakage of the electronic cigarette liquid after the electronic cigarette liquid flows through the throttle small holes; one side of the atomizing seat cover covers the atomizing seat, another side of the atomizing seat closely attaches to the liquid permeation sheet; a center of the atomizing seat cover is provided with a vapor outlet hole which communicates with the vapor outlet pipe; the atomizing seat cover is further provided with a liquid permeation opening; atomization vertical grooves are provided at one end of the atomizing seat; a space enclosed by the atomization vertical grooves, the atomizing seat cover, and the liquid permeating sheet is the atomizing chamber; the atomization unit is mounted in the atomization vertical grooves; an air inlet hole is provided at a bottom of the atomization vertical grooves in the atomizing seat; the insulating tube is inserted between an outer wall of the atomizing seat and an inner wall of the atomizer tube body.

Preferably, the atomizing seat cover is provided with an outer ring which is vertical, the outer ring is sleeved on an outer wall of a reduced diameter end of the atomizing seat; a notch, which is provided at the outer ring, engages with a protruding platform provided on the outer wall of the reduced diameter end of the atomizing seat.

Preferably, the center of the atomizing seat cover is provided with a circular groove; the vapor outlet hole is provided at a bottom surface of the circular groove; a bottom end of the vapor outlet pipe is inserted in the circular groove.

Preferably, the atomizing seat cover is made from a metal material.

Preferably, the atomization unit includes a liquid guiding wick and an electric heating wire that winds around a middle section of the liquid guiding wick; two ends of the liquid guiding wick insert through a liquid permeating opening of the atomizing seat cover and abut the liquid permeation sheet.

Preferably, the atomizing seat has a cylindrical structure; the atomization vertical grooves include two pairs of opposite-positioned vertical grooves forming a cross-shaped structure; one pair of the atomization vertical grooves are smaller in width and depth comparing to the other pair of the atomization vertical grooves; the liquid guiding wick is U-shaped and is mounted in the one pair of the atomization vertical grooves that are smaller in width and depth.

Preferably, the connecting member is inserted into the atomizer tube body at an outer end of the atomizer connection segment; the connecting member is sleeved on a bottom end of the atomizing seat; the connecting member includes a connecting seat which is provided with an inner thread and serves as an electrode, a nail electrode which is inserted into a center of the connecting seat, an insulation sleeve which is provided between the connecting seat and the nail electrode; a center of the nail electrode is provided with a venting hole communicating with the air inlet hole of the atomizing seat.

The nozzle has a mouthpiece cavity with a large cross-section; the inner diameter of the vapor outlet pipe gradually increases from the end connected to the atomization chamber to the end connected to the mouthpiece cavity. These features allow a large amount of vapor to pass through the nozzle and increase the flow rate of the vapor at the end of the vapor outlet pipe connected to the atomization chamber, which ensure sufficient airflow in the atomization chamber and quickly bring out the vapor generated by an atomization unit, ultimately increase atomization efficiency. The heat generated can also be taken away quickly, preventing the burning of the internal structures of the atomization device as a result of heat accumulation during the high-temperature operation of the atomization unit, maintaining the normal operation of the electronic cigarette. The mouthpiece cavity can also be used for accommodating spices, flavorings, shredded tobacco leaves, flavor additives and the like. These materials can disperse flavors that can mix with the electronic cigarette vapor, providing different tastes for the user.

DETAILED DESCRIPTION OF THE ILLUSTRATED EMBODIMENTS

Figure 1:
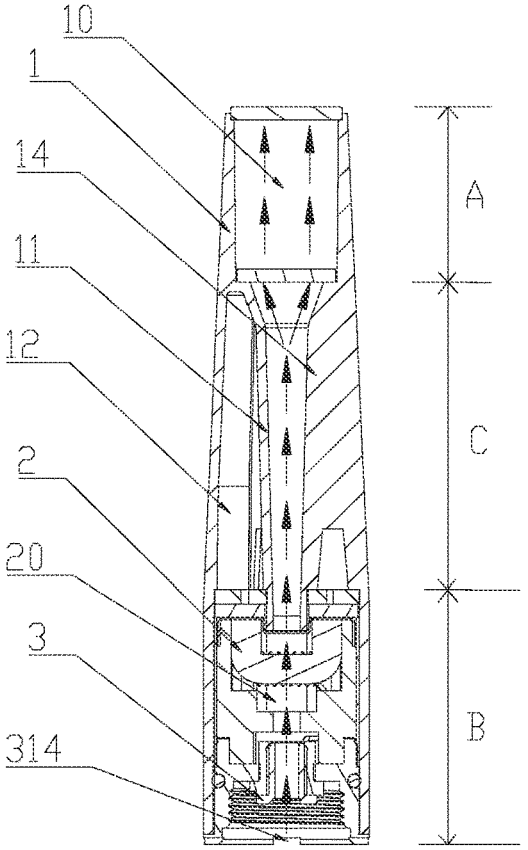
FIG. 1 is a cross-sectional view of an electronic cigarette atomizer according to an embodiment of the present invention.

To more clearly illustrate the objective, technical solutions, and beneficial effects of the present invention, the present invention will be further described in detail below with reference to the accompanying drawings and embodiments.

As shown in FIGS. 1, 2, 5 and 6, the electronic cigarette atomizer with a flared vapor outlet pipe of the present invention comprises an atomizer tube body 1, an atomization device 2, and a connecting member 3. One end of the atomizer tube body 1 is a mouthpiece segment A, the other end is an atomizer connection segment B, and the middle section in between is a liquid storage segment C. The atomization device 2 is provided with an atomization chamber 20. The connecting member 3 is for connecting with the battery rod of the electronic cigarette (not shown in the figures). The mouthpiece segment A contains a hollow mouthpiece cavity 10 which can accommodate an additional material. The mouthpiece cavity 10 has a large cross-section, which allows a large amount of vapor to pass through. The mouthpiece cavity 10 can also be used for accommodating spices, flavorings, shredded tobacco leaves, flavor additives and the like. These materials can disperse flavors that can mix with the electronic cigarette vapor, providing different tastes for the user. The mouthpiece cavity 10 can also be used to accommodate materials that can absorb unatomized liquid droplets; these materials include sponge, natural or synthetic cotton, desiccants, among others. This avoids liquid droplets being sucked into the mouth, improving the smoking experience. The atomization device 2 and the connecting member 3 are inserted into the atomizer connection segment B. A vapor outlet pipe 11 is provided in the liquid storage segment C at its central axis. The vapor outlet pipe is integrally formed with the atomizer tube body 1. The two ends of the vapor outlet pipe 11 respectively communicate with the atomization chamber 20 and the mouthpiece cavity 10. The inner diameter of the vapor outlet pipe 11 gradually increases from the end connected to the atomization chamber 20 to the end connected to the mouthpiece cavity 10. This gradual increase of the inner diameter allows the flow rate of the vapor to increase at the end of the vapor outlet pipe 11 connected to the atomization chamber 20. This ensures sufficient airflow in the atomization chamber 20 to quickly bring out the vapor generated by an atomization unit 25, thereby increasing the amount of vapor without increasing the volume of the atomization chamber, ultimately increasing atomization efficiency. The heat generated can also be taken away quickly, preventing the burning of the internal structures of the atomization device as a result of heat accumulation during the high-temperature operation of the atomization unit, maintaining the normal operation of the electronic cigarette. A liquid storage chamber 12 for storing electronic cigarette liquid is formed between the vapor outlet pipe 11 and the atomizer tube body 1. The atomization device 2 is connected to the liquid storage chamber 12 and the vapor outlet pipe 11; the atomization device 2 atomizes the cigarette liquid contained in the liquid storage chamber 12, the vapor generated is discharged through the vapor outlet pipe 11.

Figure 2:
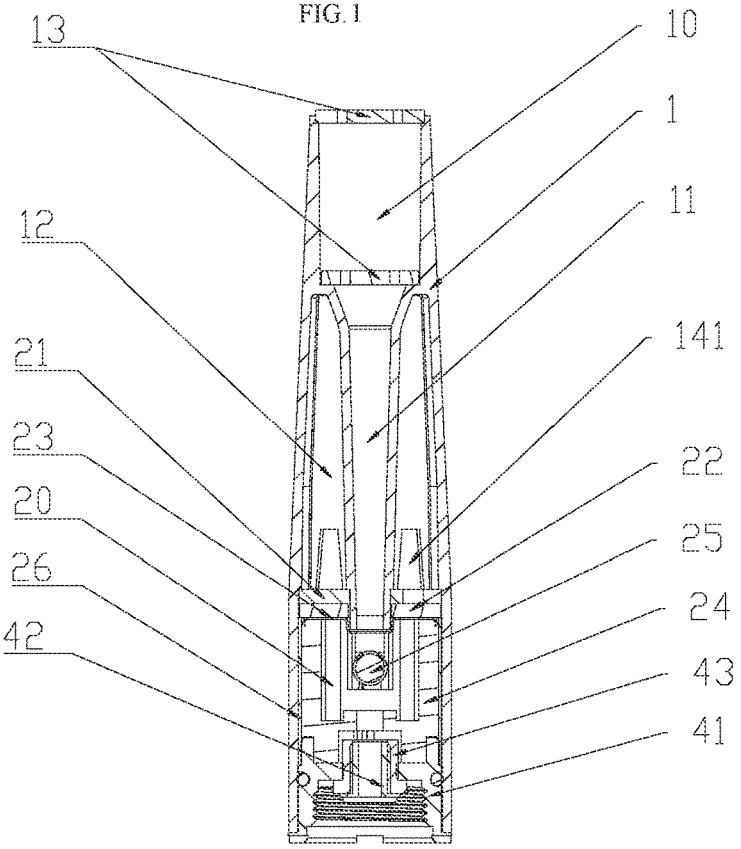
FIG. 2 is another cross-sectional view of an electronic cigarette atomizer according to an embodiment of the present invention.
Figure 3:
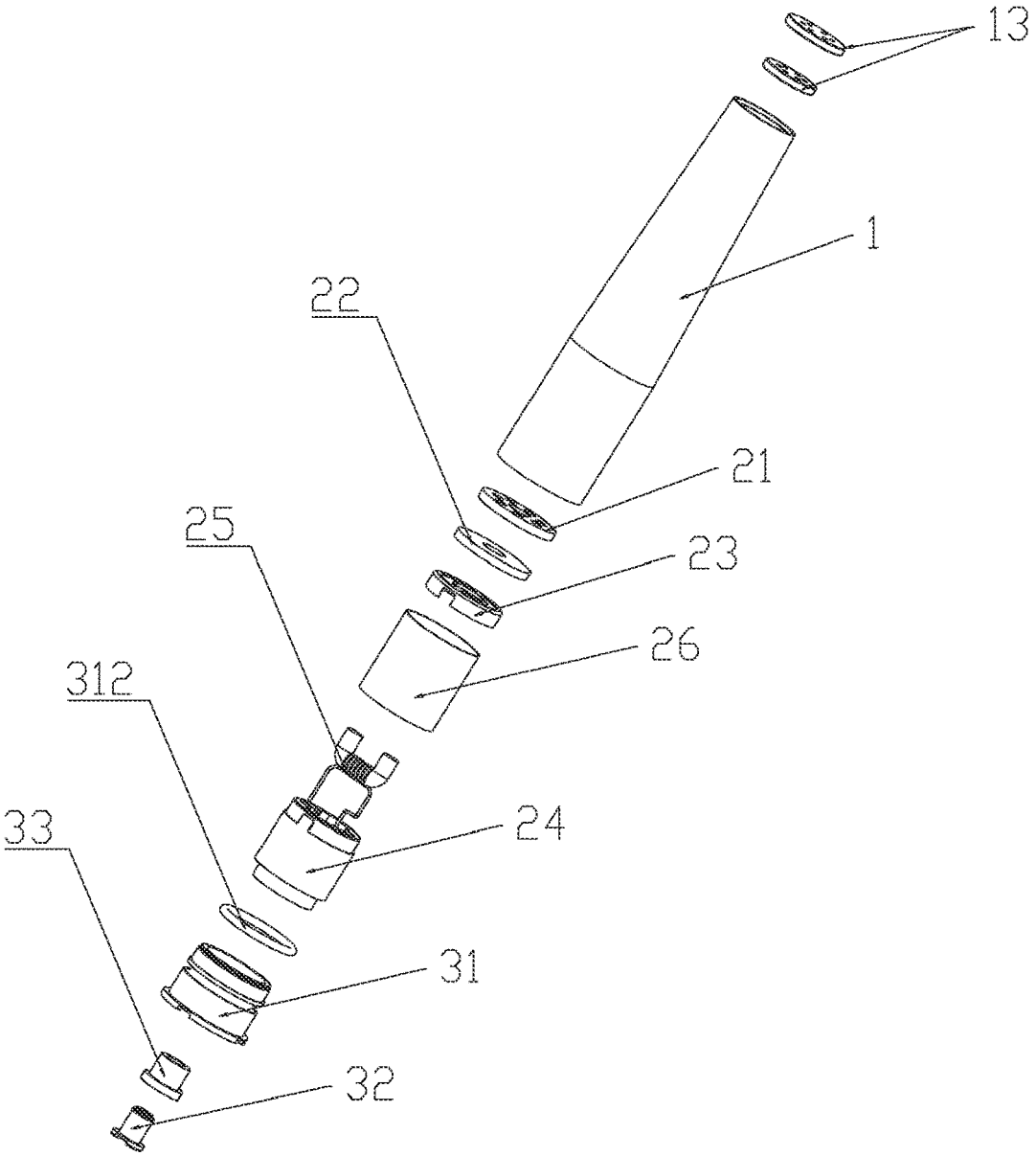
FIG. 3 is an exploded view of an electronic cigarette atomizer according to an embodiment of the present invention.
Figure 4:
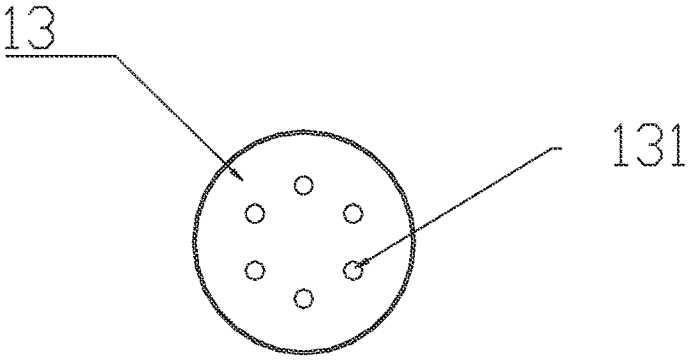
FIG. 4 is a top view of a blocking sheet according to an embodiment of the present invention.
Figure 5:
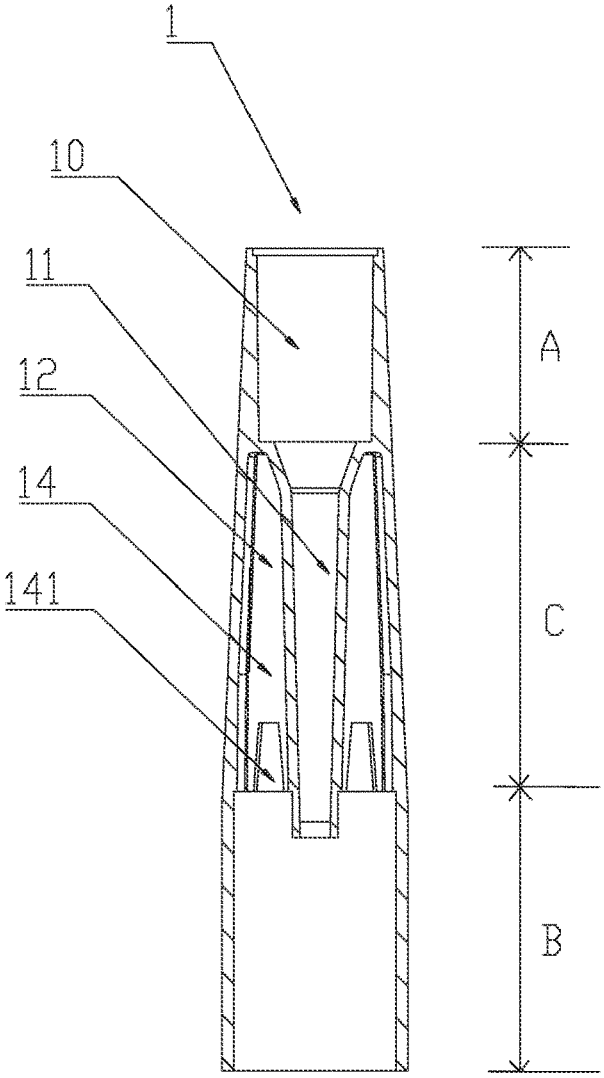
FIG. 5 is a cross-sectional view of an atomizer tube body according to an embodiment of the present invention.
Figure 6:
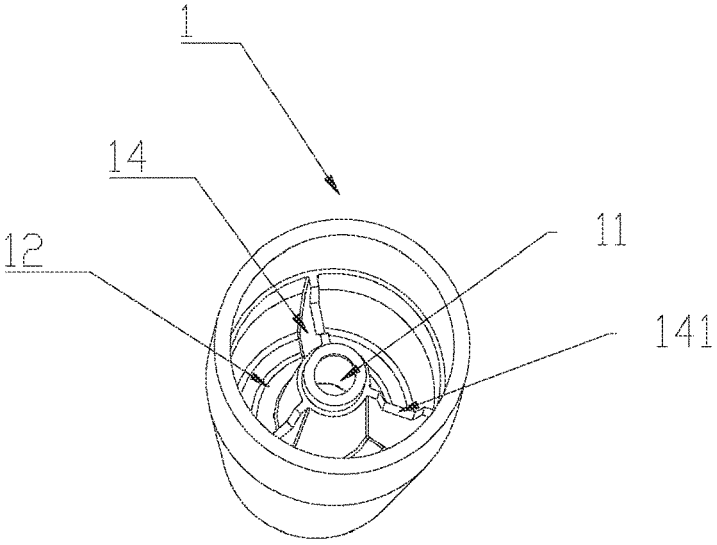
FIG. 6 is a perspective structural view of an atomizer tube body according to an embodiment of the present invention.
Figure 7:
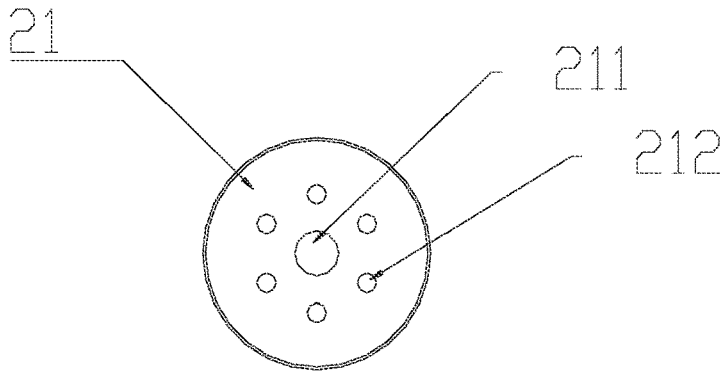
FIG. 7 is a top view of a throttle support sheet according to an embodiment of the present invention.
Figure 8:
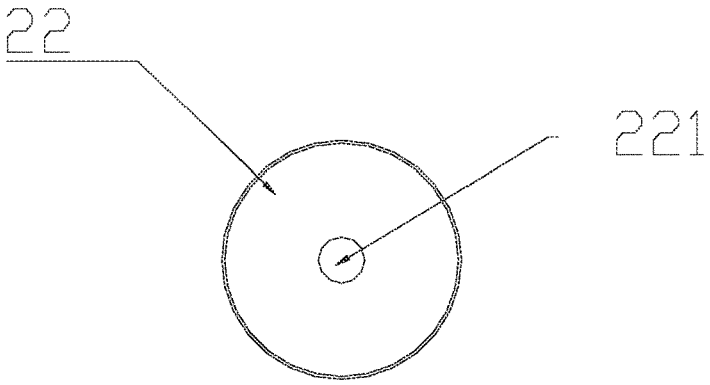
FIG. 8 is a top view of a liquid permeation sheet according to an embodiment of the present invention.
Figure 9:
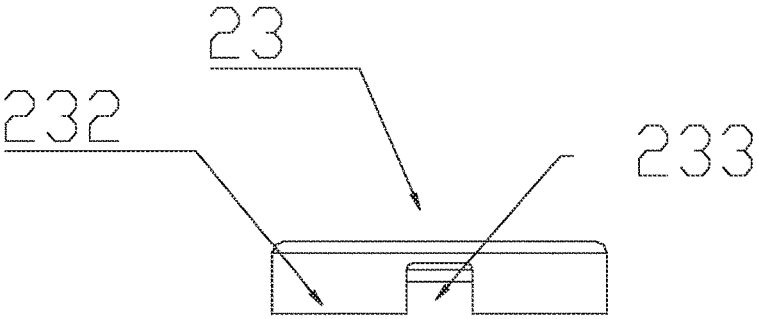
FIG. 9 is a front view of an atomizing seat cover according to an embodiment of the present invention.
Figure 10:
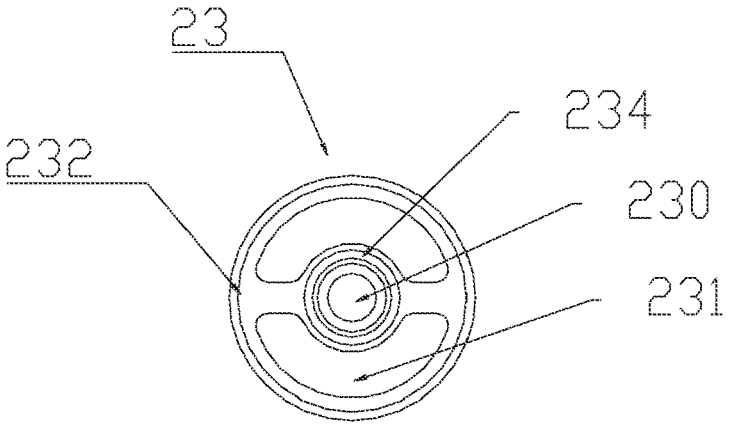
FIG. 10 is a top view of an atomizing seat cover according to an embodiment of the present invention.
Figure 11:
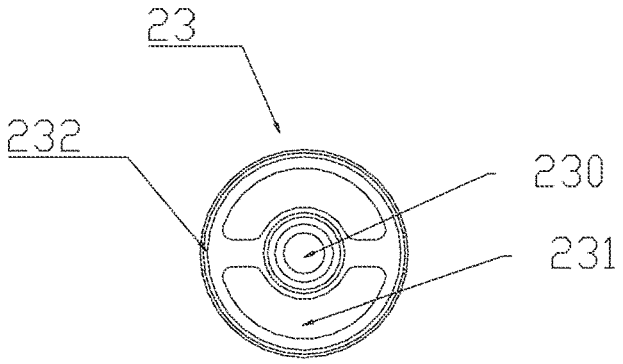
FIG. 11 is a bottom view of an atomizing seat cover according to an embodiment of the present invention.
Figure 12:
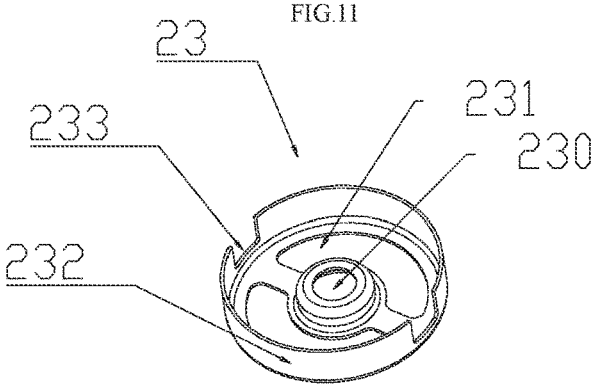
FIG. 12 is a perspective structural view of an atomizing seat cover according to an embodiment of the present invention.
Figure 13:
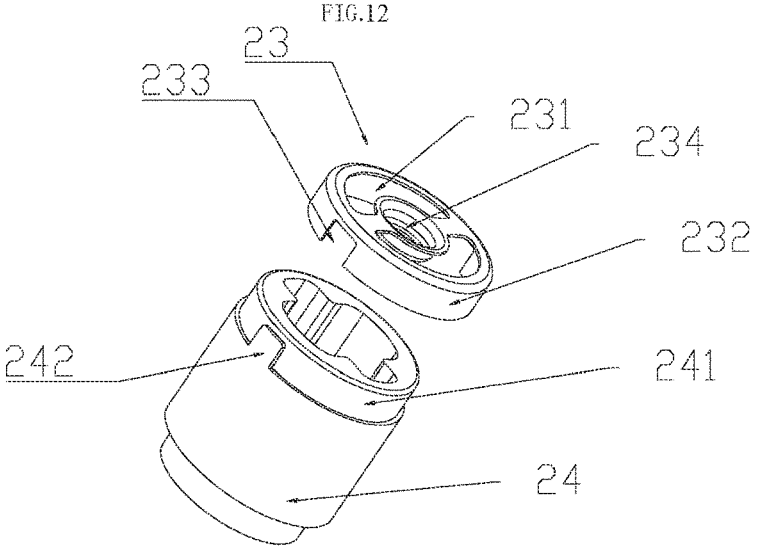
FIG. 13 is an exploded view of an atomizing seat and an atomizing seat cover according to an embodiment of the present invention.
Figure 14:
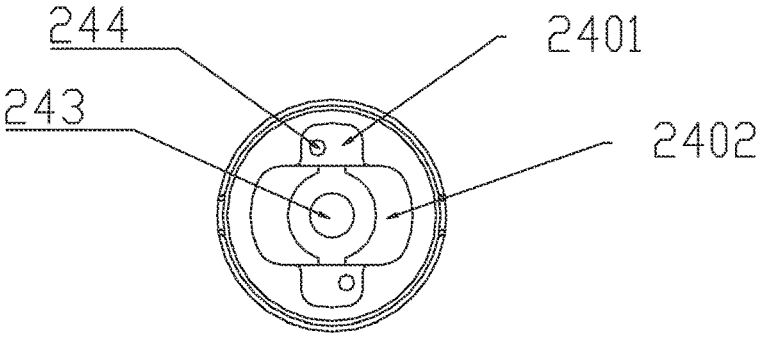
FIG. 14 is a top view of an atomizing seat according to an embodiment of the present invention.
Figure 15:
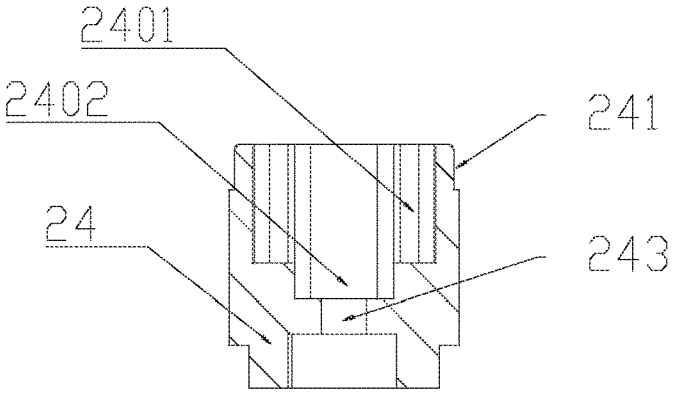
FIG. 15 is a cross-sectional view of an atomizing seat according to an embodiment of the present invention.
Figure 16:
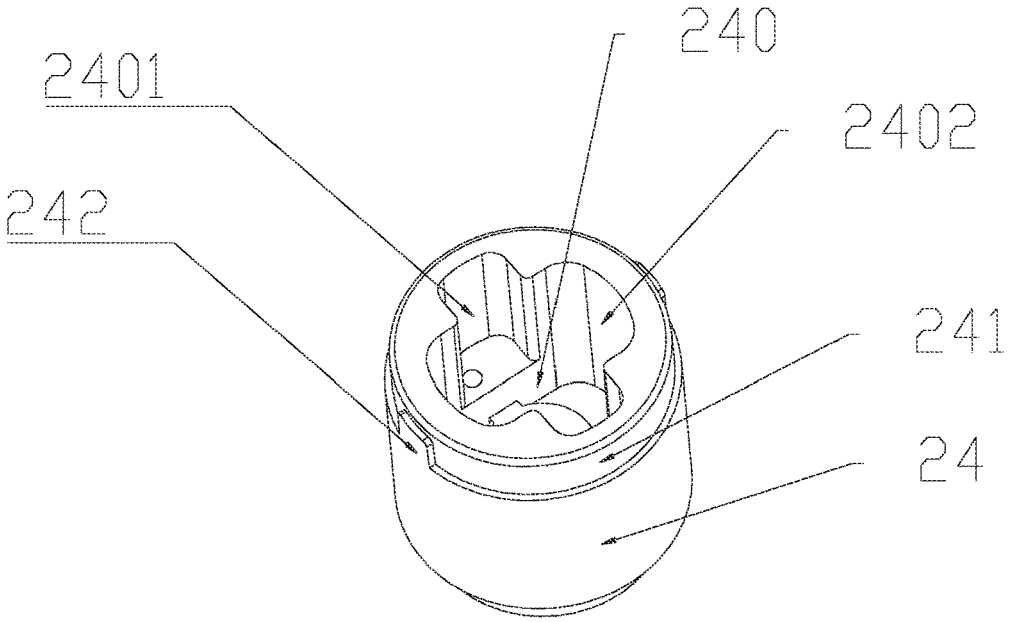
FIG. 16 is a perspective structural view of an atomizing seat according to an embodiment of the present invention.
Figure 17:
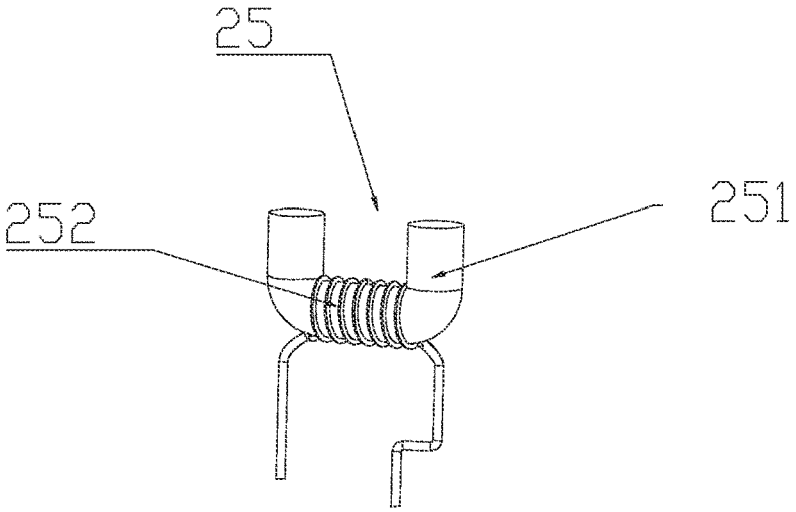
FIG. 17 is a perspective structural view of an atomization unit according to an embodiment of the present invention.
Figure 18:
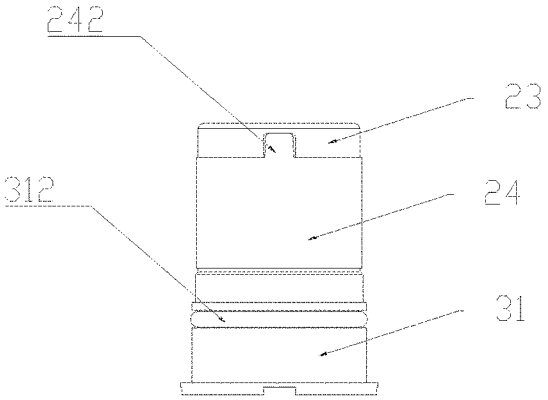
FIG. 18 is a front view of an atomizing seat cover, an atomizing seat, and a connecting member according to an embodiment of the present invention.
Figure 19:
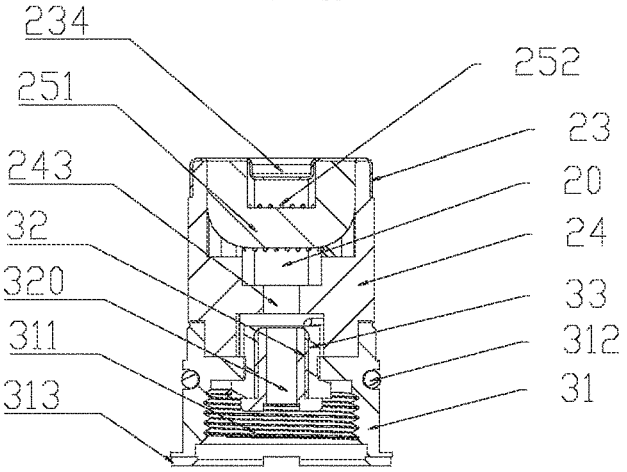
FIG. 19 is a cross-sectional view of an atomizing seat cover, an atomizing seat, and a connecting member according to an embodiment of the present invention.
Figure 20:
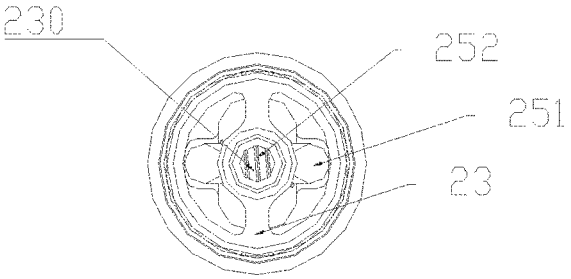
FIG. 20 is a top view of an atomizing seat cover, an atomizing seat, and a connecting member according to an embodiment of the present invention.
Figure 21:
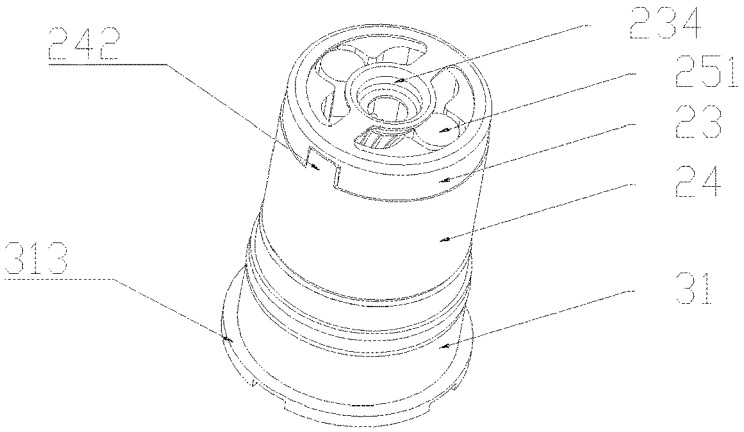
FIG. 21 is a perspective structural view of an atomizing seat cover, an atomizing seat, and a connecting member according to an embodiment of the present invention.

As shown in FIGS. 2, 3 and 4, the two ends of the mouthpiece cavity 10 are respectively provided with a blocking sheet 13. The blocking sheet 13 is provided with a plurality of small through holes 131. When the mouthpiece cavity 10 is filled with materials such as spices, flavorings, shredded tobacco leaves, flavor additives and the like, the blocking sheet 13 not only prevents these materials from blocking the vapor outlet pipe 11 but also prevents these materials from falling out. These small through holes 131 ensure that the flow of vapor is unobstructed.

As shown in FIGS. 1, 2, 5 and 6, an integrally formed ribbed plate 14 is provided between the vapor outlet pipe 11 and the atomizer tube body 1 along the axial direction. The ribbed plate 14 is provided with ribbed plate through holes 141 to allow the circulation of the cigarette liquid stored in the liquid storage chamber. The ribbed plate 14 radially connects and fixes the vapor outlet pipe 11 and the atomizer tube body 1 to prevent their deformation and displacement, which ensures the stable operation of the atomizer. The ribbed plate 14 also acts as a support frame to support the throttle support sheet 21 described below. This prevents the leakage of the cigarette liquid as a result of the liquid permeation sheet 22 being unable to seal the liquid storage chamber 12 due to the falling off and displacement of the throttle support sheet 21.

As shown in FIGS. 1, 2, 3, and 7-21, the atomization device 2 includes a throttle support sheet 21, a liquid permeation sheet 22, an atomizing seat cover 23, an atomizing seat 24, an atomization unit 25, and an insulating tube 26. The centers of the throttle support sheet 21 and the liquid permeation sheet 22 are respectively provided with a central hole 211(221) through which the vapor outlet pipe 11 passes through. The throttle support sheet 21 is further provided with a plurality of throttle small holes 212. The throttle support sheet 21 abuts the end surface of the ribbed plate 14 and seals the liquid storage chamber 12. The liquid permeation sheet 22 is closely attached to the throttle support sheet 21 to allow the cigarette liquid to penetrate through while preventing the leakage of the cigarette liquid after it flows through the throttle small holes 212. One side of the atomizing seat cover 23 covers the atomizing seat 24, the other side closely attaches to the liquid permeation sheet 22. This arrangement supports and fixes the liquid permeation sheet 22 and covers the atomizing seat 24. The space enclosed by the atomizing seat cover 23 and the atomization vertical grooves 240 in the atomization seat 24 is the atomization chamber 20. The center of the atomizing seat cover 23 is provided with a vapor outlet hole 230 which communicates with the vapor outlet pipe 11. The atomizing seat cover 23 is further provided with a liquid permeation opening 231. The atomization vertical grooves 240 are provided at one end of the atomizing seat 24; the space enclosed by the atomization vertical grooves 240, the atomizing seat cover 23, and the liquid permeating sheet 22 is the atomizing chamber 20. The atomization unit 25 is mounted in the atomization vertical grooves 240. An air inlet hole 243 is provided at the bottom of the atomization vertical grooves 240 in the atomizing seat 24. The insulating tube 26 is inserted between the outer wall of the atomizing seat 24 and the inner wall of the atomizer tube body 1. In the present embodiment, the insulating tube 26 is made from a metal; it can isolate a high-temperature accumulation point and dissipate heat from this point, allowing heat insulation and heat dissipation.

As shown in FIGS. 9-13, the outer edge of the atomizing seat cover 23 is provided with an outer ring 232 which is vertical. The outer ring 232 is sleeved on the inner wall 241 of a reduced diameter end of the atomizing seat 24. The outer diameter of the outer ring 232 equals to that of the atomizing seat 24. A notch 233, which is provided at the outer ring 232, could engage with a protruding platform 242 provided on the inner wall 241 of the reduced diameter end of the atomizing seat. The engagement of the notch 233 and the protruding platform 242 prevents the displacement of the atomizing seat cover 23 with respect to the atomizing seat 24 in the circumferential direction. This ensures that both ends of the liquid guiding wick 251 described below could insert through the liquid permeation opening 231 of the atomizing seat cover 23 and abut the liquid permeation sheet 22. The center of the atomizing seat cover 23 is provided with a circular groove 234, and the vapor outlet hole 230 is provided at the bottom surface of the circular groove 234. The bottom end of the vapor outlet pipe 11 is inserted in the circular groove 234 to protect the bottom end of the vapor outlet pipe 11, preventing the heat generated by the atomization unit 25 in the atomization chamber 20 during its high-temperature operation directly burning the vapor outlet pipe 11. The atomizing seat cover 23 of the embodiment of the present invention is made from a metal foil. The outer ring 232 of the atomizing seat cover 23 is in contact with the insulating tube 26 mentioned above. Both the atomization cover 23 and the insulating tube 26 are made from a metal material. Metal has good thermal conductivity; therefore the atomizing seat cover 23 can quickly dissipate the high temperature in the atomization chamber 20.

As shown in FIGS. 13 to 16, the atomizing seat 24 has a cylindrical structure. The atomization vertical grooves 240 include two pairs of opposite-positioned vertical grooves forming a cross-shaped structure. The width and depth of one pair of atomization vertical grooves 2401 are smaller than the other pair of atomized vertical grooves 2402. A vertical groove refers to a groove that extends vertically downwards. A smaller depth refers to a shallower groove.

As shown in FIGS. 1, 15-17, and 19-21, the atomization unit 25 includes a liquid guiding wick 251 and an electric heating wire 252 that winds around the middle section of the liquid guiding wick 251. The liquid guiding wick 251 is U-shaped and is mounted in the pair of atomization vertical grooves 2401 with smaller width and depth. In this way, the electric heating wire 252 in the middle section of the liquid guiding wick 251 can be laterally suspended in the atomization vertical grooves 240, ensuring that the electric heating wire 252 is not in direct contact with the atomizing seat 24. This prevents the electric heating wire 252 from burning, preventing the damage of the electronic cigarette atomizer. Both ends of the liquid guiding wick 251 insert through the liquid permeating openings 231 of the atomizing seat cover 23 and abut the liquid permeation sheet 22.

As shown in FIGS. 1 to 3 and FIGS. 19 to 21, the connecting member 3 is inserted into the atomizer tube body 1 at the outer end of the atomizer connection segment B. The connecting member 3 is sleeved on the bottom end of the atomizing seat 24. The connecting member 3 includes a connecting seat 31, a nail electrode 32, and an insulation sleeve 33. The connecting seat 31 is provided with an inner thread 311 and serves as an electrode. The nail electrode 32 is inserted into the center of the connecting seat 31. The insulation sleeve 33 is provided between the connecting seat 31 and the nail electrode 32 and is employed for the insulation between the two electrodes. The center of the nail electrode 32 is provided with a venting hole 320 communicating with the air inlet hole 243 of the atomizing seat. In the embodiment of the present invention, the outer wall of the connecting seat 31 is further provided with a ring groove (not shown in figures). The ring groove is provided with a sealing ring 312 for sealing the gap between the connecting seat 31 and the atomizer tube body 1. The bottom end of the connecting seat 31 is radially provided with a shoulder 313. The shoulder 313 is used to position the connecting seat 31 when it is mounted in the atomizer tube body 1. This avoids the connecting seat 31 overly protrudes into the atomizer tube body 1.

According to the structure described above, the operation of the electronic cigarette atomizer with a flared vapor outlet pipe of the present invention is as follows: when the user smokes from the nozzle of the electronic cigarette, the outside air enters from the opening 314 at the end of the connecting member 3 of the electronic cigarette atomizer. The air then enters the atomization chamber 20 through the venting hole 320 of the nail electrode and the air inlet hole 243 of the atomizing seat. At this time, the electric heating wire 252 is in operation to atomize the electronic cigarette liquid; the electronic cigarette liquid is transferred from the liquid storage chamber 12 to the liquid guiding wick 251 via the throttle support sheet 21 and the liquid permeation sheet 22. The vapor generated by atomization is drawn into the vapor outlet pipe 11 and the mouthpiece cavity 10 from the atomization chamber 20 and finally into the user's mouth. The direction in which the air and the vapor flow is as indicated by the arrows in FIG. 1.

The aforementioned embodiments are only the preferred embodiments of the present invention. They are not intended to limit the present invention. Variations and modifications in accordance with the spirit of the present invention are possible. All equivalent changes and modifications made within the scope of the claims of the present invention should fall within the scope of protection of the present invention.

What is claimed is:

1. An electronic cigarette atomizer with a flared vapor outlet pipe, the electronic cigarette atomizer comprising an atomizer tube body, an atomization device, and a connecting member; one end of the atomizer tube body is a mouthpiece segment, another end of the atomizer tube body is an atomizer connection segment, and a middle section of the atomizer tube body is a liquid storage segment; the atomization device is provided with an atomization chamber; the connecting member is for connecting with a battery rod of an electronic cigarette; the mouthpiece segment contains a mouthpiece cavity which has a large cross section and can accommodate an additional material; the atomization device and the connecting member are inserted into the atomizer connection segment; the vapor outlet pipe is provided in the liquid storage segment at its central axis, the vapor outlet pipe is integrally formed with the atomizer tube body; two ends of the vapor outlet pipe respectively communicate with the atomization chamber and the mouthpiece cavity; an inner diameter of the vapor outlet pipe gradually increases from an end connected to the atomization chamber to an end connected to the mouthpiece cavity; a liquid storage chamber for storing an electronic cigarette liquid is formed between the vapor outlet pipe and the atomizer tube body; the atomization device is connected to the liquid storage chamber and the vapor outlet pipe to discharge vapor generated after atomizing the electronic cigarette liquid contained in the liquid storage chamber through the vapor outlet pipe; wherein two ends of the mouthpiece cavity are respectively provided with a blocking sheet, the blocking sheet is provided with a plurality of small through holes.

2. The electronic cigarette atomizer with the flared vapor outlet pipe according to claim 1, wherein a ribbed plate which is integrally formed is provided between the vapor outlet pipe and the atomizer tube body along an axial direction; the ribbed plate is provided with a ribbed plate through hole to allow circulation of the electronic cigarette liquid stored in the liquid storage chamber.

3. The electronic cigarette atomizer with the flared vapor outlet pipe according to claim 2, wherein the atomization device includes a throttle support sheet, a liquid permeation sheet, an atomizing seat cover, an atomizing seat, an atomization unit, and an insulation tube; centers of the throttle support sheet and the liquid permeation sheet are respectively provided with a central hole, through which the vapor outlet pipe passes through; the throttle support sheet is provided with a plurality of throttle small holes; the throttle support sheet abuts an end surface of the ribbed plate and seals the liquid storage chamber; the liquid permeation sheet is closely attached to the throttle support sheet to allow the electronic cigarette liquid to penetrate through while preventing leakage of the electronic cigarette liquid after the electronic cigarette liquid flows through the throttle small holes; one side of the atomizing seat cover covers the atomizing seat, another side of the atomizing seat closely attaches to the liquid permeation sheet; a center of the atomizing seat cover is provided with a vapor outlet hole which communicates with the vapor outlet pipe; the atomizing seat cover is further provided with a liquid permeation opening; atomization vertical grooves are provided at one end of the atomizing seat; a space enclosed by the atomization vertical grooves, the atomizing seat cover, and the liquid permeating sheet is the atomizing chamber; the atomization unit is mounted in the atomization vertical grooves; an air inlet hole is provided at a bottom of the atomization vertical grooves in the atomizing seat; the insulation tube is inserted between an outer wall of the atomizing seat and an inner wall of the atomizer tube body.

4. The electronic cigarette atomizer with the flared vapor outlet pipe according to claim 3, wherein the atomizing seat cover is provided with an outer ring which is vertical, the outer ring is sleeved on an outer wall of a reduced diameter end of the atomizing seat; a notch, which is provided at the outer ring, engages with a protruding platform provided on the outer wall of the reduced diameter end of the atomizing seat.

5. The electronic cigarette atomizer with the flared vapor outlet pipe according to claim 3, wherein the center of the atomizing seat cover is provided with a circular groove; the vapor outlet hole is provided at a bottom surface of the circular groove; a bottom end of the vapor outlet pipe is inserted in the circular groove.

6. The electronic cigarette atomizer with the flared vapor outlet pipe according to claim 5, wherein the atomizing seat cover is made from a metal material.

7. The electronic cigarette atomizer with the flared vapor outlet pipe according to claim 3, wherein the atomization unit includes a liquid guiding wick and an electric heating wire that winds around a middle section of the liquid guiding wick; two ends of the liquid guiding wick insert through a liquid permeating opening of the atomizing seat cover and abut the liquid permeation sheet.

8. The electronic cigarette atomizer with the flared vapor outlet pipe according to claim 7, wherein the atomizing seat has a cylindrical structure; the atomization vertical grooves include two pairs of opposite-positioned vertical grooves forming a cross-shaped structure; one pair of the atomization vertical grooves are smaller in width and depth comparing to the other pair of the atomization vertical grooves; the liquid guiding wick is U-shaped and is mounted in the one pair of the atomization vertical grooves that are smaller in width and depth.

9. The electronic cigarette atomizer with the flared vapor outlet pipe according to claim 3, wherein the connecting member is inserted into the atomizer tube body at an outer end of the atomizer connection segment; the connecting member is sleeved on a bottom end of the atomizing seat; the connecting member includes a connecting seat which is provided with an inner thread and serves as an electrode, a nail electrode which is inserted into a center of the connecting seat, an insulation sleeve which is provided between the connecting seat and the nail electrode; a center of the nail electrode is provided with a venting hole communicating with the air inlet hole of the atomizing seat.

* * * * *